United States Patent [19]

Argade

[11] 3,944,477

[45] Mar. 16, 1976

[54] DIAPHRAGM FOR ELECTROLYTIC CELL FOR CHLORINE PRODUCTION

[75] Inventor: Shyam D. Argade, Woodhaven, Mich.

[73] Assignee: BASF Wyandotte Corporation, Wyandotte, Mich.

[22] Filed: Oct. 15, 1974

[21] Appl. No.: 514,658

[52] U.S. Cl. ..... 204/266; 204/98; 204/128; 204/252; 204/283; 204/296

[51] Int. Cl.[2] ..... C25B 13/00; C25C 7/04

[58] Field of Search ..... 204/98, 128, 252, 263, 204/266, 282, 283, 296

[56] References Cited

FOREIGN PATENTS OR APPLICATIONS 1,081,046 8/1967 United Kingdom 42-13560 8/1967 Japan

*Primary Examiner*—G. L. Kaplan
*Assistant Examiner*—A. C. Prescott
*Attorney, Agent, or Firm*—John W. Linkhauer; Bernhard R. Swick; Robert E. Dunn

[57] ABSTRACT

In an electrolytic cell for the production of halogen and caustic from an aqueous alkali metal halide solution containing anode and cathode compartments separated by a diaphragm an improved diaphragm is provided. The diaphragm is a porous sheet material made of a tetrafluoroethylene polymer having a low amorphous content and a micro-structure characterized by nodes interconnected by fibrils having a porosity of about 50 to 90 percent and a very tortuous path of interconnection. The improved diaphragm has an extremely long service life.

7 Claims, No Drawings

DIAPHRAGM FOR ELECTROLYTIC CELL FOR CHLORINE PRODUCTION

BACKGROUND

1. Field of the Invention

This invention relates to electrolytic cells for the production of halogen from an aqueous alkali metal halide solution wherein the cell is of the diaphragm type and, more particularly, the invention relates to an improved diaphragm for that cell.

2. Description of the Prior Art

For many years, as shown by the textbook, Chlorine, ACS Monograph 154, J. S. Sconce, Editor, Reinhold Publishing Company, New York, New York, 1962, a diaphragm-type cell has been commonly used in the production of halogens such as chlorine and caustic from various alkali metal halide solutions. Among the cells disclosed therein are the well-known Hooker type cells, the Diamond type cells and filter press cells. Particularly for the Hooker and Diamond type cells it has been customary to use an asbestos deposited material as the diaphragm inasmuch as these diaphragms are fairly easily and consistently made. However, the use of asbestos has not been entirely satisfactory, especially with the advent of the newer, dimensionally stable metal anodes, inasmuch as the asbestos diaphragm tends to have a rather short service life; and now asbestos has become a suspect health hazard.

U.S. Pat. No. 3,694,281 discloses impregnating the asbestos diaphragm with polytetrafluoroethylene so as to obtain improved mechanical strengths when the diaphragm is employed under conditions of continuous operation in electrolytic cells containing an aqueous electrolyte. Another U.S. Pat. No. 3,312,614 discloses the use of a diaphragm made of polytetrafluoroethylene fabric for use in a filter press cell. The use of the fabric diaphragm is said to substantially preclude disturbances of the electrolysis plant because of overheating in the electrolytic cell. Still another U.S. Pat. No. 3,438,879 discloses a permselective diaphragm for an electrolytic cell wherein the diaphragm can be fabricated from polytetrafluoroethylene made as a woven cloth.

The textbook, *Industrial Electrochemical Processes*, edited by A. P. Kuhn, Elsevier Publishing Company, Amsterdam, 1971, in Chapter 15 at page 583 notes that a continuous mat of polytetrafluoroethylene fibers fused together at each intersection has been suggested for use in electrolytic cells; but its use as a filtering diaphragm would only become practical if the hydrophobic character which would cause occlusion of gas bubbles within the pores with a resultant increase in electrical resistance could be overcome.

SUMMARY OF THE INVENTION

In accordance with this invention there is provided in an electrolytic cell for the production of halogen and caustic from an aqueous alkali metal halide solution containing anode and cathode compartments separated by a diaphragm, the improvement comprising a diaphragm of porous tetrafluoroethylene polymer sheet material which has an amorphous content not exceeding about 5 percent and a micro-structure characterized by nodes connected by fibrils, said fibrils having a diameter of about 5 to about 1,000 angstroms, said nodes having lengths of about 0.5 to about 400 microns, said sheet having a porosity of about 50 to about 90 percent, a bulk density of less than about 1.0 and a bulk tensile strength of greater than about 3,000 pounds per square inch.

DESCRIPTION OF THE PREFERRED EMBODIMENT

Paste-forming of dispersion polymerized poly(tetrafluoroethylene) is well known commercially. Extrusions of various cross-sectional shapes such as tubes, rods and tapes are commonly obtained from a variety of tetrafluoroethylene resins, and other paste-forming operations such as calendering and are practiced commercially. The steps in paste-forming processes include mixing the resin with a lubricant such as odorless mineral spirits and carrying out forming steps in which the resin is subjected to shear, thus making the shaped articles cohesive. The lubricant is removed from the extruded shape usually by drying. In usual practice this unsintered product is heated above the polymer's melting point, generally about 327° C., causing it to sinter or coalesce into an essentially impermeable structure. However, it is the unsintered product that is the precursor of the invention.

In South African Pat. No. 713,287 (and its equivalent, French Pat. No. 2,090,775) it is disclosed that such paste-formed, dried, unsintered shapes can be expanded by stretching them in one or more directions under certain conditions so that they become substantially much more porous yet stronger. This phenomenon of expansion with increase in strength occurs with certain preferred tetrafluoroethylene resins and within preferred ranges of rate of stretching and preferred ranges of temperature. The preferred temperature range is from about 35° C. to 327° C. It has been found that certain of the shaped materials which have been simultaneously stretched in two directions in accordance with the foregoing South African patent have unique and unexpected properties making them suitable for use as diaphragms in electrolytic cells for production of halogen and caustic. For the sake of brevity, the details of formulation and preparation of these porous sheet materials disclosed in the South African Pat. NO. 713,287 are herein incorporated by reference, although certain of these details will be hereinafter repeated for the convenience of the reader.

The primary requisite of a suitable resin for use in this invention within the confines of the above South African patent is a very high degree of crystallinity, preferably in the range of 98 percent or above and correspondingly low amorphous content and, in any event, a crystallinity of at least 95 percent, i.e., and amorphous content of not more than 5 percent. It has been found that techniques for increasing the crystallinity, such as annealing at the highest possible temperature but just below the melt point, improves the performance of the resins in the expansion process. Copolymers of tetrafluoroethylene, which have defects in the crystalline structure that introduce the higher amorphous content, do not work as well in this invention as homopolymers. However, it is found, for example, that resins which contain less than 0.2 percent of hexafluoropropylene as co-monomer can be made to work in this invention by going to very high rates of expansion at high temperatures just below the melting point.

The porous micro-structure of the expanded material of this invention is affected by the temperature and the rate at which it is expanded. The structure consists of nodes interconnected by very small fibrils. In the case of uniaxial expansion the nodes are elongated, the longer axis of the node being orientated perpendicular to the direction of the expansion. The fibrils which interconnect the nodes are orientated parallel to the direction of the expansion. These fibrils appear to be characteristically wide and thin in cross-section, the maximum width being equal to about 0.1 micron (1,000 angstroms) which is the diameter of the crystalline particles. The minimum width may be one or two molecular diameters or in the range of 5 to 10 angstroms. The node may vary in size from about 400 microns to less than a micron, depending on the conditions used in the expansion. These nodes, on the average of about 50 microns in size and very irregular in shape, lie closely together and in many instances appear to touch at points. A given node is connected to adjacent or nearby nodes by the fibrils which vary in length from 5 to 500 microns depending upon the amount of expansion. The expansion results in production of spider-web-like or cross-link configurations. The porosity increases as the voids or spaces between the polymeric nodes and fibrils become more numerous and larger in size. The porous films thus formed can be subsequently laminated to form suitable structures of required properties.

It has been found that a critical combination of percent porosity and pore size in conjuntion with thickness of the diaphragm film material is necessary in order to achieve a polytetrafluoroethylene film which is wettable by the electrolytes found within the typical diaphragm type electrolytic cell, permits the electrical charge flux, hydraulic flow and yet blocks the flow of gas from one electrolyte compartment to the other. These conditions are met by the use of a polytetrafluoroethylene porous film having a thickness of 5 to 100 mils, preferably 10 to 80 mils a porosity of 50 to 90 percent with a range of pore sizes from about 0.1 to about 1.0 microns and preferably from 0.1 to 0.5 microns. These materials can be made hydrophilic by grafting polymeric chains terminating in a charged group, e.g., $SO_3^-$ or $COO^-$. Also, inorganic compounds could conceivably be permanently introduced into the porous structure. These modifications are covered by this invention although are not specifically referred to. The foregoing films have adequate properties as far as structure and tortuosity of the pores is concerned. These films seem to have good gas separation qualities which is apparent from the high bubble points for these materials. Current efficiency of cell is dependent upon the amount of hydroxyl ion back migration allowed by the diaphragm. The hydroxyl ion back migration is governed by the mobility, which is, in turn, controlled by the electrolyte velocity across a given pore. The average pore size, tortuosity and the porosity of the diaphragm are important characteristics. The thickness of the diaphragm is also important because by increasing the film thickness at a given average pore size one would have a longer path for diffusion and migration of ionic species. The ionic conductivity of the diaphragm is also a parameter of significant importance. Hence, there is a critical balance between pore size, porosity, tortuosity and thickness of the porous material. A physical determination called Gurley Number, which is the amount of time in seconds required to pass a certain volume of air (100 milliliters) through a given sample area (1 inch$^2$) using a special apparatus, takes into account the pore size, porosity, tortuosity and thickness together. Gurley Number measurement is further described and means for determination is more fully set forth in TAPPI Standard No. T460-OS68 or ASTM D-726-58 (reapproved 1971,) which, for the sake of brevity, is incorporated herein by reference. The diaphragms of this invention will preferably have a Gurley Number of 25 to 100 seconds.

Diaphragms according to the invention may be made where a number of films of the invention are bonded by an adhesive in sandwich fashion.

The porous diaphragms of this invention are installed in an electrolytic cell in much the same manner as asbestos paper or other similar diaphragms would be installed. For instance, in the filter press type of cell the porous diaphragm can be laid over the cathode and then by use of a friction clip snugly fitted along the frame edge so as to preclude leakage around the diaphragm. In a similar manner the diaphragm can be installed in other electrolytic cells such as the Hooker and Diamond types.

It is an advantage of this invention that the invented diaphragm has an extremely long service life so that the cell does not have to be reopened and rediaphragmed every 200 to 300 days as is typical with the conventional asbestos deposited diaphragms with metal anodes. The use of diaphragms of this invention makes possible the renewal of the cell from a diaphragm standpoint a matter of years instead of a matter of months as with the conventional asbestos diaphragms. Hence, this is a great economic savings to the operator of the electrolytic cell.

The following examples are included to illustrate the use of the diaphragms of the present invention in electrolytic cells but are not to be considered limiting. Unless otherwise specified, all parts are parts by weight and all temperatures are expressed as degrees Centigrade.

EXAMPLE I

A polytetrafluoroethylene film prepared by the process of the South African Pat. No. 713,287 and having a film thickness of 25 mil (i.e., 0.025 inches thickness) a nominal pore size of 0.8 to 1 micron and a porosity of 65 percent was installed in a test chlorine cell. The film was wetted with acetone and water and finally a proprietary metal surface cleaning compound in successive stages. The film was washed with water before it was installed in the test cell. The test cell anodes and cathodes each have an active electrode area of 3 inches by 6 inches. In the configuration of this cell the porous diaphragm was separated from the cathode by a polypropylene screen. With a one-quarter-inch anolyte gap and a current density of 200 amperes per square foot, the cell voltage was 3.45 volts. The current efficiency at 50 percent salt cut was about 81.5 percent. Salt cut is determined by dividing the number of moles of NaOH by the sum of a number of moles of sodium hydroxide and moles of sodium chloride in the catholyte of the electrolytic cell. When the salt cut was 40 percent, the current efficiency was 88 percent.

EXAMPLE II

A three-ply laminate of 4 mil thick porous polytetrafluoroethylene film of 0.5 grams per cubic centimeter bulk density was made with two perforated polyethylene films sandwiched in between the polytetrafluoroethylene films. The diaphragm was tested as in Example 1. At a 48 percent salt cut a current efficiency of 81.2 percent was obtained. A cell voltage of 3.60 volts at 160 amperes per square foot was observed.

EXAMPLE III

A porous polytetrafluoroethylene diaphragm having a nominal micron pore size of 0.8, a porosity of 85 percent and a thickness of 10 mil was pre-treated and installed in the chlorine test cell in the manner of Example I. The anolyte head pressure was 8 inches and had a flow rate of 6.3 milliliters per minute. The voltage was 3.40. At a salt cut of about 40 percent, a current efficiency of 77 percent was obtained.

EXAMPLE IV

A porous polytetrafluoroethylene film having a nominal pore size of 0.7 micron, a porosity of 70 percent and a thickness of 25 mil was pre-treated and installed in the chlorine test cell as in the manner of Example I. With an anolyte head pressure of 8 inches and a flow rate of 6.3 milliliters per minute, a voltage of 3.5 and at a salt cut of 40 percent, a current efficiency of 88 percent was obtained.

EXAMPLE V

Example IV was repeated that the anolyte flow rate was 5.2 milliliters per minute and the salt cut was 50 percent. The current efficiency obtained was 81.5 percent.

EXAMPLE VI

A porous polytetrafluoroethylene film having a thickness of 4 mil and a bulk density of 0.5 grams per cubic centimeter was heat laminated to a similar film with a 2 mil perforated polyethylene film being in between the polytetrafluoroethylene films. Overall thickness was 10 mil. This film was installed in a cell described in Example I. At a salt cut of 33.3 percent, a current efficiency of 81.7 percent was obtained. The cell voltage was 3.50 volts at 200 amperes per square foot.

EXAMPLE VII

A two-ply laminate made from 10 mil thick porous polytetrafluoroethylene film of 0.5 grams per cubic centimeter bulk density with perforated polyethylene film of 3 mil thickness in between was made and tested as in Example I. At 29.8 percent salt cut a current efficiency of 96 percent was obtained. A cell voltage of 3.51 at 160 amperes per square foot was obtained.

EXAMPLE VIII

A four-ply laminate of the porous polytetrafluoroethylene film of 4 mil thickness having a bulk density of 0.5 grams per cubic centimeter density and 3 layers of perforated polyethylene film sandwiched in between the porous polytetrafluoroethylene films was installed in a chlorine test cell as in Example I. At a salt cut of 58.9 percent, a current efficiency of 77.5 percent was attained. A cell voltage of 3.75 volts at 160 amperes per square foot was noted.

EXAMPLE IX

A three-ply laminate of 10 mil thick porous polytetrafluoroethylene film of 0.4 grams per cubic centimeter bulk density with perforated polyethylene film was installed in a chlorine test cell as in Example I. A flow rate of 2.0 milliliters per minute was obtained at an anolyte head of 18 inches. At a salt cut of 75.6 percent, a current efficiency of 77.1 percent was noted. A cell voltage of 3.82 volts at 160 amperes per square foot was observed.

EXAMPLE X

A laminate of the porous polytetrafluoroethylene films was made with no adhesives or other thermoplastics having a 30 mil thickness with 86 percent porosity. The film exhibited a Gurley Number of 30 seconds. The laminate porous film was installed in a chlorine test cell as in Example I. At 5-inch anolyte head it had a flow rate of 6.1 milliliters per minute. Under these conditions a salt cut of 43.8 percent and a current efficiency of 93.7 percent was obtained. A cell voltage of 3.50 volts at 200 amperes per square foot was observed.

EXAMPLE XI

An all polytetrafluoroethylene porous film laminate having a thickness of 24 mil and 86 percent pore volume and a Gurley Number of 25 seconds was tested in a chlorine cell of Example I. At an anolyte head of 10 inches a flow rate of 7.5 milliliters per minute corresponded to a salt cut of 38.2 percent with a current efficiency of 97.2 percent. A voltage of 3.85 volts at 200 ampers per square foot was observed.

EXAMPLE XII

An all Teflon porous film laminate having a thickness of 75 mil and 86 percent porosity and a Gurley Number of 90 seconds was tested in a chlorine cell of Example I. At a differential head of 15 inches of anolyte, a flow rate of 4.52 milliliters per minute was observed. At 55.7 percent salt cut a current efficiency of 91.7 percent was obtained. A cell voltage of 4.7 volts at 200 ampers per square foot was noted.

EXAMPLE XIII

An all polytetrafluoroethylene porous film laminate having a thickness of 36 mil and 81 percent porosity with a Gurley Number of 88 seconds was tested in the chlorine cell of Example I. At a differential head of the anolyte of 4 inches, a flow rate of 5.2 milliliters per minute was observed. At a salt cut of 51.8 percent, a current efficiency of 93.1 percent was obtained. A cell voltage of 3.78 volts at 200 amperes per square foot was noted for this diaphragm.

COMPARATIVE EXAMPLE

By way of comparison a MITEX diaphragm material discussed by A. T. Kuhn, supra, was compared in the test cell of Example I. The fabric (MITEX LSWP304 F-1) had a thickness of 0.005 inch and an average pore size of 5 microns. When a less than commercially acceptable salt cut of 25.4 percent was used, the resulting current efficiency was 58.8 percent. When a commercially acceptable salt cut of 42.2 percent was used, the current efficiency was 55.2 percent. These results are unsatisfactory for commercial electrolytic cells.

The foregoing examples had been described in the foregoing specification for the purpose of illustration and not limitation. Many other modifications and ramifications will naturally suggest themselves to those skilled in the art based on this disclosure. These are intended to be comprehended as within the scope of the invention.

The embodiments of the invention in which an exclusive property or privilege is claimed are defined as follows:

1. In an electrolytic cell for the production of halogen and caustic from an aqueous alkali metal halide solution containing anode and cathode compartments separated by a diaphragm, the improvement comprising:

a diaphragm of porous tetrafluoroethylene polymer sheet material which has an amorphous content not exceeding about 5 percent and a micro-structure characterized by nodes interconnected by fibrils, said fibrils having a diameter of about 5 to about 1,000 angstroms, said nodes having lengths of about 0.5 to about 400 microns, said sheet having a porosity of about 50 to about 90 percent, a bulk density of less than about 1.0 and a bulk tensile strength of greater than about 3,000 pounds per square inch.

2. The improvements of claim 1 wherein the diaphragm has a thickness of about 5 to about 100 thousandths of an inch.

3. The improvement of claim 2 wherein the porosity is about 50 to 90 percent with a pore size of 0.2 to about 1.0 microns.

4. The improvement of claim 2 wherein the thickness is 30 thousandths of an inch, the porosity is 50 to 90 percent and the Gurley Number is 25–100 seconds.

5. The improvement of claim 1 wherein the diaphragm thickness is 10 to 80 thousandths of an inch with a porosity of 85 percent.

6. The improvement of claim 1 where a number of such films are suitably bonded by an adhesive in a sandwich fashion.

7. The improvement of claim 1 where a number of such films are thermally bonded together, maintaining the polytetrafluoroethylene content to the same level.

* * * * *